US007854965B2

(12) United States Patent
Tomasella et al.

(10) Patent No.: US 7,854,965 B2
(45) Date of Patent: Dec. 21, 2010

(54) METHOD OF FORMING IMAGES OR DECORATIONS ON A SUPPORT BODY

(75) Inventors: Maurizio Tomasella, Cordignano (IT); Quintino Tome', Cordignano (IT)

(73) Assignee: Georgio Fedon & Figli S.p.A., Belluno (IT)

( * ) Notice: Subject to any disclaimer, the term of this patent is extended or adjusted under 35 U.S.C. 154(b) by 993 days.

(21) Appl. No.: 11/226,469

(22) Filed: Sep. 15, 2005

(65) Prior Publication Data

US 2006/0159851 A1 Jul. 20, 2006

(30) Foreign Application Priority Data

Jan. 14, 2005 (IT) ..... BL2005A000001

(51) Int. Cl.
*B05D 1/36* (2006.01)

(52) U.S. Cl. ..... 427/402; 427/202; 427/258; 427/372.2; 427/384; 427/407.1; 427/385.5

(58) Field of Classification Search ..... 427/470, 427/202, 205, 258, 372.2, 384, 385.5, 407.1, 427/402

See application file for complete search history.

(56) References Cited

U.S. PATENT DOCUMENTS

| | | | | |
|---|---|---|---|---|
| 3,937,854 | A | 2/1976 | Shank, Jr. | |
| 4,354,851 | A | 10/1982 | Hix et al. | |
| 4,558,329 | A * | 12/1985 | Honda | 347/176 |
| 5,520,956 | A * | 5/1996 | Kieser et al. | 427/203 |
| 6,000,793 | A | 12/1999 | Inamoto | |
| 6,165,621 | A * | 12/2000 | Kasari et al. | 428/457 |
| 6,465,046 | B1 * | 10/2002 | Hansson et al. | 427/256 |
| 7,166,330 | B2 * | 1/2007 | Takahashi et al. | 427/372.2 |
| 2004/0038036 | A1 | 2/2004 | Macedo | |

FOREIGN PATENT DOCUMENTS

| | | |
|---|---|---|
| GB | 2 362 605 | 11/2001 |
| WO | WO 01/48333 | 7/2001 |

OTHER PUBLICATIONS

Partial European Search Report for EP 05 01 9957, completed Oct. 27, 2008, 4 pages.

First Examination Report filed in Israel Patent Appln. No. 172378, dated Feb. 7, 2010.

* cited by examiner

*Primary Examiner*—Michael Cleveland
*Assistant Examiner*—Alex Rolland
(74) *Attorney, Agent, or Firm*—Nixon & Vanderhye P.C.

(57) ABSTRACT

The present invention relates to a method of forming images or decorations on a support comprising the following steps in sequence:

arranging at least one support;

applying at least one coloring material onto at least one surface of said support;

coating said at least one surface with at least one protecting compound;

causing said protecting compound to harden thereby forming an uninterrupted fixing and protecting layer for said at least one coloring material.

30 Claims, 2 Drawing Sheets

1
Z
5

2
7a
7b
7
9
10
8

4

11

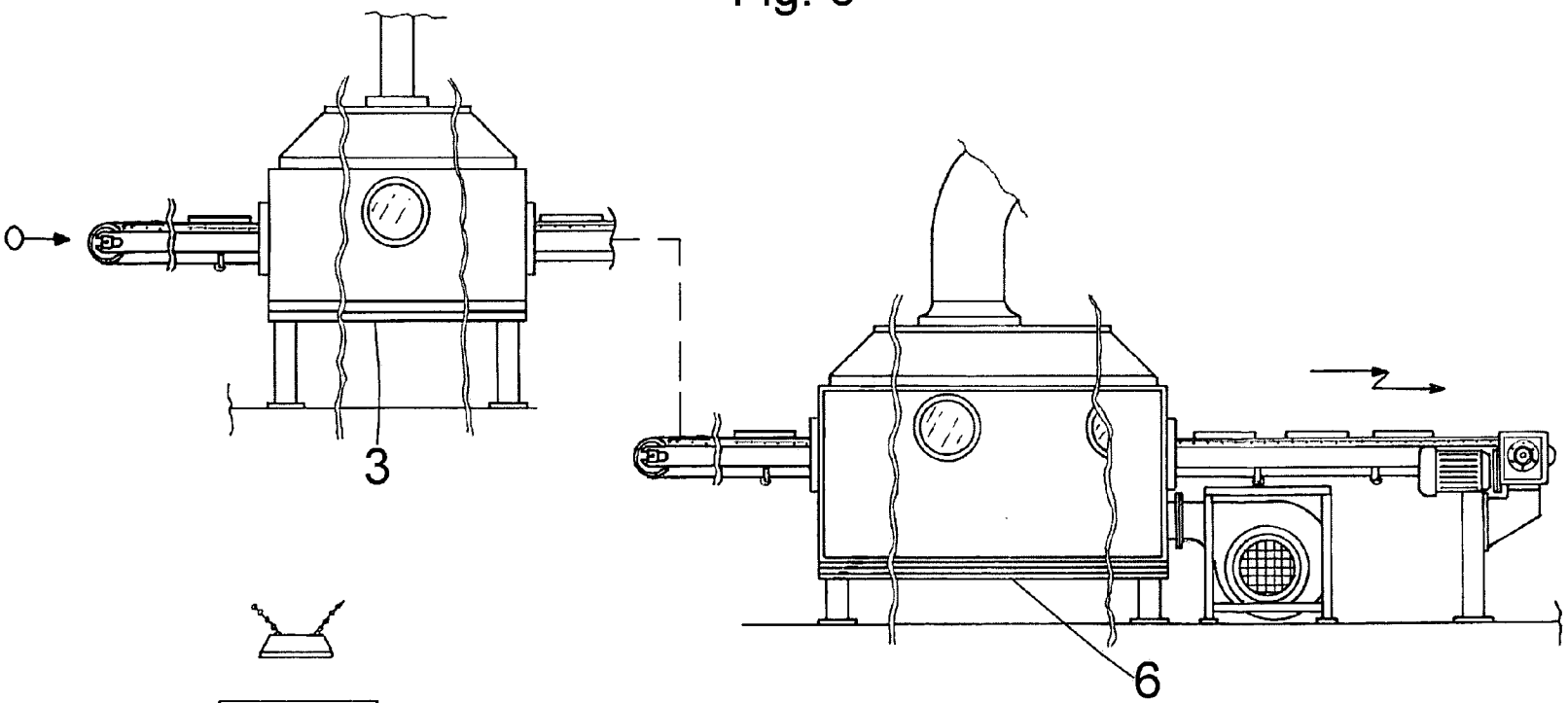
Fig. 6
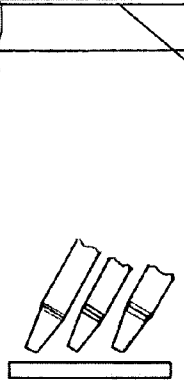
Fig. 7
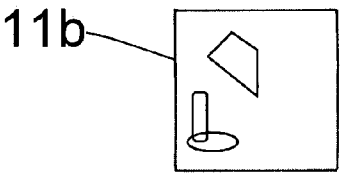
Fig. 8
Fig. 9

METHOD OF FORMING IMAGES OR DECORATIONS ON A SUPPORT BODY

FIELD OF THE INVENTION

The present invention relates to a method of forming images or decorations on a support body, e. g. a panel, a metal sheet, a surface of a three-dimensional body, and a support body bearing an image obtained with such a method or process.

BACKGROUND OF THE INVENTION

Powder paints for use as coating materials are well known in the art and comprise resins, pigments and additives. Powder paints are applied onto metal supports by being spread in the air, caused to electrostatically adhere to the surface of metal supports, and then heated to polymerization temperature so as to obtain permanent adhesion to the metal support.

Generally speaking, powder paints have a low impact on the environment, while ensuring good protection to the surface of a support body to which they are applied. Other conventional methods of application are adopted for coating non metal plane surfaces, e. g. deposition by making use of a dispenser device. Application times of powder paints are quite short and the range of obtainable colors is wide.

More important, owing to the fact that powder paints do not include any specific solvent evaporating when undergoing polymerization, their use has shown very low risk of causing human diseases.

Due to all such advantages the powder paint technique for finishing metallic and non metallic articles has been adopted since many years in place of solvent paint technique.

Moreover substantial efforts have been made to develop powder paint techniques for image formation on various kinds of support.

U.S. Pat. No. 4,395,263 discloses a process to produce a laminate with permanent decorations by a sublimatic transfer printing process according to which an image is sublimatically transferred by heating.

Such a process provides for the following stages:

- arranging a rolled metal support comprising at least one binding material surface stratum including a predetermined pigment;
- coating the binding material stratum with a transparent layer of thermosettable material receptive to a sublimatic dyestuff;
- heat curing or drying the rolled metal support;
- arranging an auxiliary carrier web, such as a paper sheet, on which a "negative" image is formed by sublimatic dyestuff;
- transferring, e. g. by contact and heat-induced sublimation, the sublimatic dyestuff from the auxiliary carrier web to the transparent layer.

In this way, a "positive" image on the metal support is not directly formed but is transferred from an auxiliary carrier to a transparent layer, thus the image is impressed or fixed by transfer on the outer surface of the transparent layer.

U.S. Pat. No. 4,354,851 discloses a method for making a decorated water-resistant rigid panel. In such a method use is made of a dried or cured rigid panel and a printed sheet, the printed sheet bearing a decoration formed by a sublimatic coloring agent. One surface of the rigid panel is coated with a transparent polymeric cover and may have an additional substrate coating or layer of polymeric or other materials. The printed sheet is put and kept into contact with the rigid panel coated surface, and pressure or heat is then applied to the printed sheet, whereby causing transfer of sublimatic coloring agent from the printed sheet to the transparent polymeric cover.

U.S. Pat. No. 4,657,557 discloses a sheet for sublimatic transfer by heat application of a sublimatic color-based decoration. The decoration preparation includes the following stages:

- coating one surface of a transfer sheet or film surface with sublimatic inks, and its other surface with a heat-resistant resin;
- drying of inks and resin;
- coating an image-receiving support with a polymerizing resin;
- putting the transferring sheet or film into contact with the image-receiving support;
- heating in order to cause the decoration to be transferred from the transfer sheet to the image-receiving support.

WO-2004/035311 patent application discloses a process for decorating a substrate by transferring onto it at least one sublimatic ink.

Such a process includes the stages of:

- coating a substrate surface with a polymeric transparent or translucent polymer;
- putting a transfer sheet into contact with the coated substrate surface; and
- transferring an image or decoration from the transfer sheet to the coated surface.

U.S. Pat. No. 6,686,315 discloses a method of coating a building material surface comprising:

- arranging a building material having a surface coated with a sublimatic ink-based image receiving substrate;
- printing a transfer image on a transfer means (paper sheet); and
- transferring the image from the transfer means to the substrate.

The above-mentioned patents disclose and teach processes for forming an image on a support involving the use of an auxiliary carrier, such as a paper sheet, on which an image or a decoration is formed, in most cases a "negative" of the image or decoration to be fixed on a support, the image being obtained by a sublimatic ink. The auxiliary carrier is brought into contact with the support, preferably at a support portion provided with a layer of material receptive to the sublimatic ink, whereby causing transfer of sublimatic ink "positive" image from the auxiliary carrier to the support. Image transfer is made easier by applying heat at a predetermined temperature to the carrier while being in contact with the support.

The image or decoration obtained by such a technique has a high image definition but involves substantial waste of sublimatic ink, that only partly sublimates during the image formation process.

Moreover, the auxiliary carrier, often cannot be re-used after image transfer, and thus has to be discarded.

SUMMARY OF THE INVENTION

An object of the present invention is to provide a method of forming images or decorations on many kinds of bi-dimensional or three-dimensional support, article or object, which can be carried out in an easy and rapid way.

Another object of the present invention is to provide a method which makes it possible to obtain a surface decorated object or panel in a cost effective way.

Another object of the present invention is to provide a method of forming images or decorations on the surface of objects, which does not involve waste of material, such as carrier and/or ink.

Another object of the present invention is to provide a method of obtaining decorated articles or objects provided with high definition images or decorations in bright colors on their surface.

Another object of the present invention is to provide a method of obtaining long-lasting color images on the surface of articles or objects.

These and other objects that will better appear below are achieved by a method of forming images or decorations on a support comprising the following steps in sequence:

arranging at least one support;

applying at least one coloring material onto at least one surface of said support;

coating said at least one surface with at least one protecting compound;

causing said protecting compound to harden thereby forming an uninterrupted fixing and protecting layer for said at least one coloring material.

Advantageously, said at least one coloring material comprises one or more sublimatic inks.

Preferably, said protecting compound is a powder paint, more preferably a resin-based paint which is selected from the group comprising acrylic, aliphatic, aromatic, epossidic, epossipolyester, melaminic, polyester, polyurethanic-based paint.

PREFERRED EXAMPLES OF CARRYING OUT THE INVENTION

Further features and advantages of a method according to the present invention will better appear from the following detailed description of presently preferred Examples of carrying out the invention.

It has been found that by applying to the surface of a support (e. g. a metal sheet or a ceramic tile) at least one ink, preferably a sublimatic ink, defining a desired image and then applying a hardenable protecting compound to the inked support, and causing the protecting compound paint to harden thereby forming an ink coating and protecting layer, a long-lasting image can be fixed to the surface of a support.

According to the present invention, inks are preferably sublimatic inks, and are applied to a support in amounts ranging from 1 to 25 g/m$^2$ preferably by means of a printer, preferably an ink-jet printer.

A method according to the present invention is preferably carried out by printing one or more sublimatic inks forming a desired image on a support surface, covering the printed surface with a powder paint, and then causing said powder paint to harden or polymerize, e. g. by heating, to form a protecting layer for the ink image.

Most preferably, powder paints are caused to harden or polymerize either before or substantially simultaneously with evaporation of the solvent of the sublimatic ink or inks, thereby avoiding ink dispersion, and above all allowing the ink or inks to become bound to the paint protecting layer while the powder paint undergoes a polymerization or hardening process.

Advantageously, the powder paint layer while hardening holds in position the sublimatic ink image underneath it, although allowing ink solvent(s), e. g. water, to sublimate and escape through it, thereby at least partly fixing the ink image to the polymerized paint layer.

It has been surprisingly found that upon hardening or polymerization most of the resin-based powder paints selected from the above-mentioned group, cause a "lens effect", i. e. a perceivable improvement in the ink color brightness (after sublimation), whereby obtaining a good well-defined permanent image on a support. The lens effect can be improved by providing more than one layer of powder paint on the coloring material. In such a case, brighter ink colors are obtained.

According to the present invention the support surface can be pre-treated, e. g. painted or coated before being imaged or printed, i. e. before coloring material(s) such as sublimatic inks are applied to it in order to obtain a background layer, preferably in color contrast with the ink image to be formed thereon. Pre-treatment is preferably carried out by using one or more of the resin-based powder paints referred to above.

In the following Examples illustrating ways of carrying out the method according to the present invention:

a) Powder paints (identified as 411-09-19450—112-06-05205—009-00251—530-40006—530-10004—059-11320—704-0-6882) were applied by a manual electrostatic apparatus Zeus, Model 98, manufactured by Zeus Electrostatic System S.r.l. at Argenta—Ferrara (Italy), whereas the amount of applied powder was ranging from about 30, i.e. an amount sufficient to at least partly cover the support surface to be imaged, to 50 μm.

b) "Cross-cut test" is a test method of assessing the stripping strength of a hardened paint coating portion cut as a right-angle pattern, also including the background layer, if any, in the support surface. The method may be carried out as a "pass/fail" test or as a six-step classification test. The stripping strength thus measured depends, among other factors, upon the adhesion of the coating layer to either a background layer or the support surface. Cross-cut tests were carried out by means of an Erichsen Cross Hatch Cutter, Model 295, supplied by Erichsen Instruments srl of Milan.

c) "Pencil test" provides for pressing a pencil point onto a surface treated according to a method of the present invention, and assess if the surface becomes marked or not. In the Examples use was made of pencils having a B (soft), F (medium) and H (hard) hardness.

d) Sublimatic inks normally release their solvent(s) at a temperature ranging from 100° C. to 300° C.

e) The printer used in all the Examples was a Roland instrument Model SJ-740 (www.rolanddg.com). The printing processes were carried out with a 360 dpi resolution using an amount of ink ranging from 3 to 20 g/m$^2$.

f) The sublimatic inks were selected from the group comprising:

(i) cyan, magenta, yellow and black sublimatic inks supplied by Much Colours company at Montesilvano—Pescara (Italy);

(ii) Sublitex Giallo, Sublitex Magenta, Sublitex Ciano, Sublitex Nero, Sublitex Nero Plus, Sublitex Light Ciano, Sublitex Light Magenta;

Sublistar Giallo, Sublistar Magenta, Sublistar Ciano, Sublistar Nero, Sublistar Light Ciano, Sublistar Light Magenta;

Cartuccia Mimaki Sublimatico Cyan, Cartuccia Mimaki Sublimatico Magenta, Cartuccia Mimaki Sublimatico Black, Cartuccia Mimaki Sublimatico Yellow, Cartuccia Mimaki Sublimatico Light Cyan, Cartuccia Mimaki Sublimatico Light Magenta and Cartuccia Mimaki Sublimatico Blue supplied by Cekin srl at Galliera Veneta-Padua (Italy);

(iii) ink digistar pes hd black, ink digistar pes hd black plus, ink digistar pes hd yellow, ink digistar pes hd magenta, ink digistar pes hd cyan, ink digistar pes hd light cyan and ink digistar pes hd light magenta supplied by Euroscreen srl at Sassuolo—Modena (Italy);

(iv) DIG/C 1000, DIG/M 1000, DIG/G 1000, DIG/B 1000, DIG/LC 1000, DIG/LM 1000, web-paper sublimatic inks;

IS/C, IS/M, IS/G, IS/N, IS/CL and IS/ML web-paper or web sublimatic inks supplied by J-Teck3 srl in Como (Italy);

(v) cyan, magenta, yellow, black, light cyan and light magenta supplied by AMC Color srl in Genoa (Italy).

All the Examples were carried out by using different kind of sublimatic inks and no substantial differences in image quality were detected when a sublimatic ink was used in place of another one. Accordingly, the specific kind of sublimatic ink(s) used is not specified in the following Examples.

Example 1

A metal sheet Fe 36 with a thickness of 8/10 mm and size of 600×600 mm was pre-treated, i. e. coated with 40 μm of 411-09-19450 PP BIANCO CA RAL 9016 LF OP T powder paint provided by Pulverlac—Rohm and Haas Spa at Romano d'Ezzelino—Vicenza (Italy)—briefly referred to as paint 411-09-19450 hereinbelow—which is a thermosetting powder paint comprising saturated carboxylated polyester resins, to obtain a background layer after heat-treatment.

The pre-heated metal sheet was then fed to a Roland printer and printed with a sublimatic ink at a 360 dpi resolution.

The printed image was unclear.

Eiseffekt powder paint 009-00251 provided by Tigerwerk Lack—u. Farbenfabrik GmbH & Co. KG.—4600 Wels (Austria) was uniformly applied to the printed surface so as to fully coat the metal sheet surface by using a manually operated electrostatic apparatus Zeus Model 98 to obtain a protecting layer for the printed image.

The metal sheet was then placed on an overhead conveyor traveling at a rate of 1.5-2 m/min throughout a hot-air oven provided with a 300,000 Kcal diesel-burner, manufactured by Pessot Fratelli s.n.c. at Gaiarine—Treviso (Italy) in order to heat the sheet for 7 minute inside the oven at an average temperature of 200° C.

While undergoing a heat process in the oven, sublimation of the ink took place and progressively the printed image or images become visible or developed, while the ink solvent (water) escaped through the powder paint of the protecting layer that become gradually hardened or polymerized and transparent although slightly opaque. It is believed that in this process the ink colors of the image become fixed to the transparent protecting layer.

Advantageously, while heat hardening the powder paint apparently slightly shrinks, i. e. it takes a slightly corrugated or texturized configuration at least at its outer surface, thereby showing a multiplicity of relatively small dome-like areas that are deemed to be at least partly responsible for an overall "lens effect" thus enhancing the brightness of the ink colors and three-dimensional definition of the fixed image or images.

The metal sheet once recovered from the oven was left at room temperature for 5 minutes and then subjected to a cross-cut test. The cross-cut test result was good.

Example 2

The same method as in Example 1 was followed except that after printing stage 30-50 μm of powder paint 112-06-05205 MP LF LU TR, hereinafter designated by the reference numeral 112-06-05205, which is a thermosetting powder comprising saturated polyester resins and solid epossidic resins, supplied by Pulverlac, Rohm and Haas spa, was used instead of powder paint 009-00251.

The printed image was a scale of colors. The quality of the resulting fixed image was very good.

A second step of application of 112-06-05205 onto the hardened protecting layer was then carried out. An image showing brighter colors was obtained.

A third step of application of 112-06-05205 had no appreciable effect on the image definition or the color brightness.

Example 3

An image representing a floral composition was printed on a Fe sheet and treated with 411-09-19450 as in Example 1.

The sheet was then coated with powder paint 009-00251 and heat treated at 200° C. for 2 minute, in an infrared oven manufactured by Infragas Nova Impianti S.n.c. at Leinì—Turin (Italy).

Rapid evaporation of water (solvent) occurred and bright colors were obtained in the fixed image.

The imaged metal sheet was subjected to a second heating step. No improvements or variations in the fixed image were detected.

On the imaged metal sheet a cross cut test was then carried out with good results.

Example 4

The method steps of the Example 1 were carried out except that powder paint 009-00251 was replaced by metallized blue paint 530-40006 (provided by Tigerwerk Lack). The printed image was the ink image of an ant.

The sheet was then heated as in Example 3.

The obtained fixed image was of very good quality with good quality with excellent three-dimensional definition.

Example 5

The method steps as in the Example 1 were repeated using an aluminium square sheet 10 mm in thickness.

A heating step was carried out by locating the printed aluminum sheet on the conveyor traveling at a low rate of 1 m/min in view of the relatively large thickness of the aluminum sheet. The conveyor was traveling through an infrared oven supplied by Infragas.

The obtained image was of excellent quality.

Cross-cut test and pencil test gave good results (H-2H hardness).

Example 6

The method steps of Example 1 were repeated using a white ceramics tile 200×200×10 mm in size.

Printing step was carried out by means of a Roland SJ-740 plotter issuing a reduced amount of ink to prevent ink from floating on the surface finishing of the ceramics tile.

The printed ceramics tile was heated first in an infrared oven (Infragas) to cause melting of the powder and then loaded onto a conveyor traveling through a hot-air oven. The conveyor rate along the hot-air oven was 2 m/min. The tile was heated at 210° C. for 10 minute in the infrared oven during which the protecting layer became transparent and the printed image colors moderately bright.

After treatment in the hot-air oven image definition and color brightness became good.

A cross-cut test and a pencil test gave good results (H-2H hardness).

Example 7

The method steps of Example 6 were repeated and after the infrared heating step, a second powder paint 009-00251 was heat applied onto the eiseffekt powder paint layer to assist in forming a double protecting layer. The tile was then heated in a hot-air oven as in the Example 6.

The overall aesthetic quality of the image was better than that reached in Example 6, the colors being firmly fixed to the powder paint in the protecting double layer.

The protecting layer after being hardened or polymerized was transparent although slightly opaque.

The double-layer of transparent protecting paint had a total thickness of 80-100 μm and gave the printed image an excellent three-dimensional effect.

A cross-cut test and a pencil test gave good results (H-2H hardness).

Example 8

A white tile 200×200×10 mm in size was pre-heated in an infrared oven (Infragas). A powder paint 411-09-19450 was heat applied, and thereafter the tile was let to cool at room temperature. An ink image was then printed as in Example 6 and 7 and coated with a powder paint 112-06-05205 successively.

The tile was then heated in an infrared oven, as in Example 6, to obtain a lucid transparent protecting layer.

The resulting image had bright colors and good three-dimensional definition. A cross-cut test and a pencil test gave good results (H-2H hardness).

Example 9

The method steps of Example 8 were repeated.

After heating of the tile in the infrared oven powder paint 112-06-05205 was applied.

The tile was heat treated in a hot air oven as in Example 6.

The obtained image was well defined with bright colors and good three-dimensional effect.

Thus, two layers of transparent protecting paint apparently enhance the three-dimensional definition of the developed image due to a lens effect following hardening or polymerization of the powder paints.

Example 10

The method steps of Example 8 were repeated and the same image of Example 8 was enlarged 4 times and printed by allotments on 4 tiles each having size 200×200×10 mm.

The obtained aesthetic effect of the overall developed image was good and fully similar to that of Example 8 on each of the 4 tiles.

Example 11

The method steps of Example 1 were repeated except that a non-sublimatic ink was printed on a metal sheet by making use of an inkjet printer by Epson with resolution ranging from 360 dpi to 1440 dpi. The images thus from obtained showed fading or dull colors and poor definition.

A powder paint 112-06-05205 was then further applied and heat hardened but no improvements in the image definition was noted.

Example 12

The method steps of Example 1 were repeated except that Talken spray 1005 including water solvent provided by Talken Color s.r.l. at Legnano—Milan (Italy) was used instead of powder paint 009-00251. The ink became watery during hardening of the protecting layer and thus the obtained image had dull colors.

Example 13

The method steps of Example 8 were repeated except that use was made of polyurethanic powder 704-0-6882 provided by Europolveri Spa at Sandrigo—Vicenza (Italy) instead of eiseffekt powder paint 009-00251. The polyurethanic powder after polymerization, resulted in a transparent although slightly opaque layer having relatively high hardness characteristics.

The features of the developed image were excellent, a pencil text indicated a value of 3H, and a cut-cross test gave very good results.

Example 14

Polyester-based powder paint 059-11320 Ral 9010 supplied by Tigerwerk Lack was applied as a background to 12 aluminum sheets 400×400×8 mm in size which were then heat treated at 210° C. for 10 minutes in a hot-air oven (Officine F.lli Pessot). The aluminum sheets were then let to cool to room temperature and the image of a bike and a barrow was printed on four of the sheets, whereas undefined images were printed on the remaining eight sheets. All the sheets were printed by a sublimatic ink.

Powder paint 059-11320 Ral 9010 was again applied onto the ink images as a protecting layer and the aluminum sheets were heat treated at 210° C. for 10 minutes in a hot-air oven.

The obtained images were not quite marked although showing a good definition by being net and clear. Pure polyester is resistant to atmospheric agents and to UV radiation and thus it can be advantageously used for producing images on objects designed to be located outside, e. g. when used as tiles on building facades or outer walls.

A cross-cut test and a pencil test gave good results (H-2H hardness).

After 90 days of exposure to atmospheric agents no surface deterioration was detected on the sheets.

Example 15

The method steps of the Example 14 were repeated on 3 aluminum panels 1200×600×10 mm in size to be used for example as garden table tops.

The panels were heat treated at 210° C. for 15 minutes, the treatment time being longer than that of Example 14 as the plane mass was much larger.

Final effect was similar to that obtained with ceramics tiles and the edges became rounded off.

Example 16

25 tiles of light grey raw ceramics 600×600×10 mm in size were printed with sublimatic ink at a 360 dpi resolution. The printing rate with such a resolution is high due to the fact that the amount of sublimatic ink for each print is low, i. e. 3÷20 $g/m^2$, the plotter adjusts its printing rate on the base of the desired resolution, a low resolution allowing a higher printing rate. A low resolution is generally adopted since when a high amount of ink is used the image quality is impaired as the ink is not fully or properly fixed or absorbed by the protecting layer.

Powder paint 009-00251 supplied by Tigerwerk Lack was applied to the tiles onto the printed ink images. The tiles were then heat treated at 210° C. for 12 minutes in a hot-air oven and good quality images obtained.

The tiles were subjected to cut-cross test and no-scratches were detected on plane surfaces. The pencil test result was good.

The planes were subjected to repeated foot stamping for a few days and no scratches were formed on their imaged surfaces.

Example 17

A medieval castle image of sublimatic inks was printed on one surface of a panel 600×1200×30 mm in size supplied by Eraclit Spa Marghera—Venice (Italy).

A white powder paint 530-10004 provided by Tigerwerk Lack was applied to the panel to act as a protecting layer. The panel was heat treated at 200° C. for 2 minute in a radiating-wall oven (Infragas).

Exceptional results were obtained both on smooth surfaces, such as plaster, and on rough surfaces, such as pressed straw panels.

An imaged panel was exposed for 3 month, and still is, to atmosphere agents, such as sun, powders, humidity and brine, and no image alteration have been detected.

Example 18

The method steps of Example 17 were repeated and the reproduced image was a bike with barrow printed on a plaster-like surface of a panel.

The final result was of excellent quality.

Example 19

A plasterboard panel 600×600×10 mm in size was treated as in Example 17 and the ink printed image was a red color motorcycle.

The resulting image was of good quality.

Example 20

A white powder paint 530-10004 supplied by Tigerwerk Lack was applied as a background layer to a MDF (Medium density Fibreboard) Metalwood board 800×1200×18 mm in size provided by Fantoni spa at Osoppo—Udine (Italy). MDF is an engineered wood (engineered wood includes a range of derivative wood products which are manufactured by binding together wood strands, fibers, or veneers with adhesives to form composite materials) product formed by breaking down softwood into wood fibers combining it with wax and resin, and forming panels by applying high temperature and pressure.

The MDF went twice through an infrared oven at 200° C. for 2 minutes.

An image of a multicolor hunting scene was then ink printed on the background layer.

A powder paint 009-00251 provided by Tigerwerk Lack was applied to the inked board surface and the board was conveyed twice through an infrared oven (each time at 200° C. for 2 minutes). The protecting layer after being hardened or polymerized become transparent although slightly opaque.

The developed image thus obtained had excellent chromatic features.

Adherence and hardness test gave good results.

Example 21

A MDF board 800×400×18 mm in size supplied by Fantoni spa was coated with a background layer of melaminic resin and on its surface so coated an image (a multicolor hunting scene) was printed using sublimatic inks.

A layer of powder paint 009-00251 provided by Tigerwerk Lack was then applied to the board. The board was then conveyed twice through an infrared oven (each time for 2 minutes at 200° C.).

The final image was of very good quality.

Example 22

A sublimatic ink was printed directly on a glass sheet 600×600×6 mm in size. The ink did not adhere uniformly to the glass surface and drops were formed and thus the printed image became altered.

Example 23

A powder paint 009-00251 provided by Tigerwerk Lack was applied as a background layer onto a glass sheet 600×600×6 mm in size. The sheet was then conveyed through an infrared oven at 200° C. for 2 minutes whereby causing melting of the powder. An ink image was printed on the background layer, and the same paint 009-00251 was applied to the ink printed surface of the glass sheet. The glass sheet was then placed in a hot-air oven at 210° C. for 12 minutes.

The test results were excellent, and the developed image had bright colours, while the coating adhered very well to the glass and the protecting layer, transparent although slightly opaque, showed good surface hardness.

Example 24

A powder paint 112-06-05205 provided by Pulverlac was applied to a glass sheet 600×600×6 mm in size, and the sheet thus treated was conveyed through an infrared oven for 2 minutes at 200° C., whereby causing melting of the paint to obtain a transparent background layer. An ink image was printed on the background layer and the same paint 112-06-05205 was applied as a protecting layer for the printed image.

The sheet was then placed in a hot-air oven for 12 minutes at 210° C.

The obtained sheet had a lucid-like appearance bearing a good quality image.

Example 25

The method steps of the Example 6 were repeated, and after applying the resin, a tile 200×200×10 mm in size was conveyed through an infrared oven for 1 minute and 40 seconds.

The tile was let to cool to ambient temperature after which a polymerization test was carried. The transparent paint of the background layer detached quite easily from the tile presumably due to the fact that the transparent paint was insufficiently polymerized. This test clearly indicated that the colors after sublimation became mainly fixed to the protecting layer.

Example 26

The method steps of Example 1 were repeated, except that thermoplastic resin Rilsan was used instead of powder paint 009-00251. The metal sheet was heat treated by being conveyed throughout an infrared oven at 200° C. for 1 minute and 40 seconds. Rilsan melting point is at 186° C. and above this temperature Rilsan soon reticulates, and thus no further heat treatment was required.

The resulting image quality was excellent.

Example 27

A stainless steel sheet 1500×1000 mm in size was cleaned with nitro diluent and "AIFOS" logo was printed on the sheet by making use of sublimatic inks.

Powder paint powder 112-06-05205 on the sheet was applied to the ink printed surface of the sheet and the steel sheet was conveyed through a hot-air oven at 200° C. for 7 minutes.

The resulting image was of good quality.

Example 28

The method steps of the Example 1 were repeated, except that instead of carrying out a printing operation sublimatic ink was poured in drops onto a metal sheet. The ink did not uniformly spread out on the metal surface. After heat treatment in the oven the result was of very poor quality as the ink drops did not sublimate to a sufficient extent.

All the above Examples showed that setting inks, preferably sublimatic inks, when applied to a support surface and coated by a protecting compound or paint, preferably a resin-based powder paint caused to harden or polymerize, e. g. by heat treatment, give rise to a permanent image, which can be advantageously predetermined and generated by a printer (ink-jet printer).

The protecting layer hold in position the sublimatic ink colors and is permeable to the ink solvent(s) while hardening thereby fixing thereto a solventless ink image pre-formed underneath it.

Of course the method according to the invention also includes the use of coloring materials other than sublimatic material, e. g. pastels, chalk and the like.

BRIEF DESCRIPTION OF THE DRAWINGS

According to another aspect of the present invention there is provided a plant for carrying out the invention, which is shown by way of non limiting example in the following drawings, in which:

FIG. 6 is a side view of a second portion of a plant according to the present invention;

FIGS. 7 and 8 are cross sectional views of detail of the plant of FIG. 6; and FIG. 9 shows the object of FIG. 5 imaged by a method according to the present invention.

Figures 1, 2, 3, 4, 5:
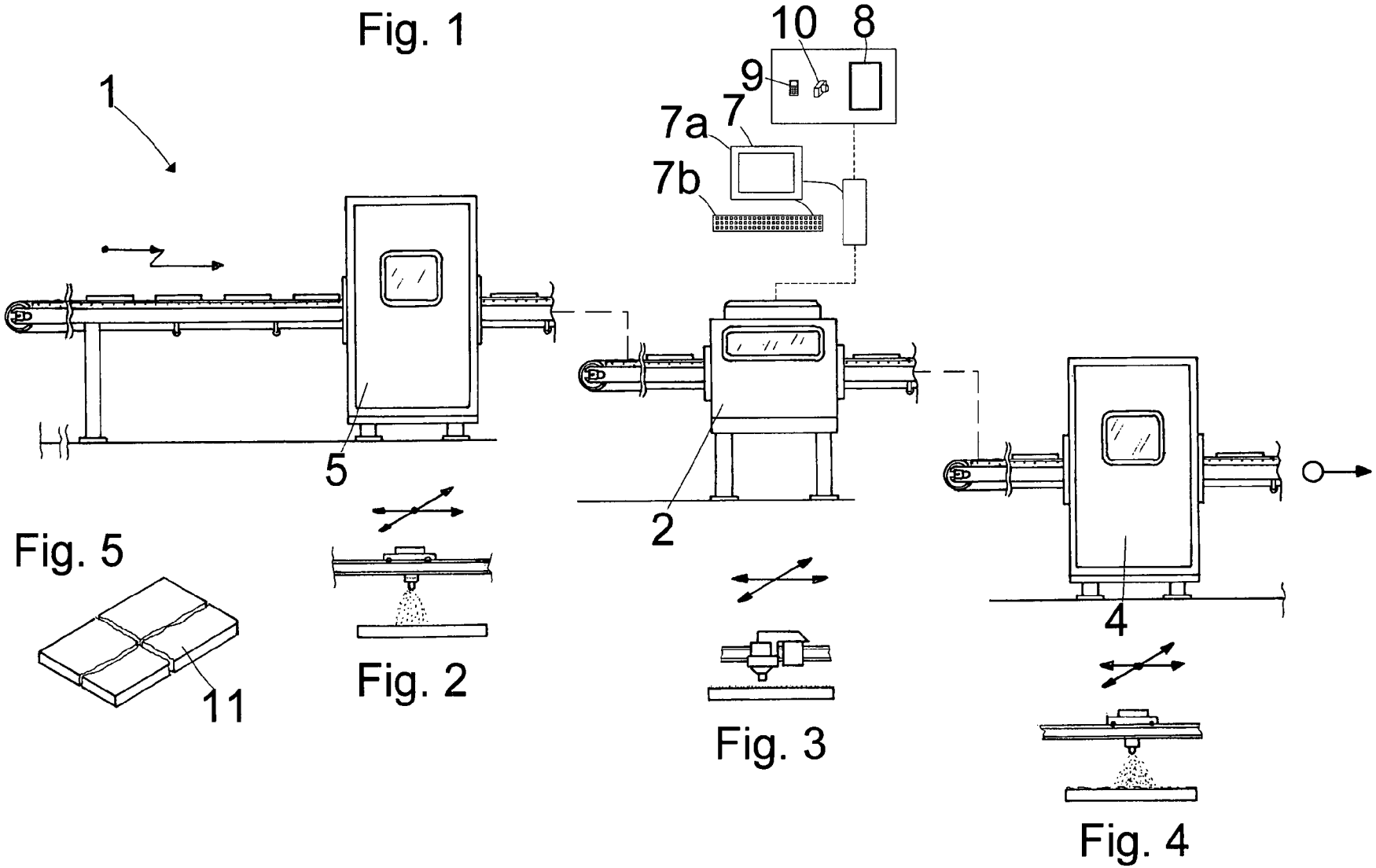
FIG. 1 is a side view of a portion of a plant according to the present invention.
FIGS. 2, 3 and 4 are cross sectional views of detail of the plant of FIG. 1.
FIG. 5 shows an object on which an image has to be formed with a method according to the present invention.

DESCRIPTION OF THE PREFERRED EMBODIMENT OF A PLANT FOR CARRYING OUT THE INVENTION

With reference to the above listed Figures, a plant 1 for carrying out a method for forming images or decorations according to the present invention comprises a printer 2, an oven 3 and a powder paint distributing 4. Advantageously the printer is an ink-jet printer and the oven is an infrared oven or a hot-air oven.

A plant according to the present invention preferably comprises a distributing 5, similar to the distributing 4, and a suitable cooler 6, more preferably comprises a peripheral unit controlled directly by a user or by a control unit. The user by means of peripheral unit(s) or control unit(s) sets the image which has to be formed on the object surface(s).

Peripheral units comprise a computer 7, provided with a monitor 7*a* and a keyboard 7*b*, a scanner 8, a mobile phone 9, or a digital photocamera 10. Advantageously the scanner, mobile phone, and digital photocamera can send the image to be formed to the computer or to a control unit which controls the printer.

In such a plant 1, objects 11 to image are pre-treated coating them with a powder paint by means of the distributing 5, then are fed to the printer 2, which prints, with sublimatic inks, an image or a decoration on the objects.

Printed or imaged objects 11 are coated with a powder paint by means of the powder paint distributing 4 similar to that used in the pre-treating step.

The objects are then heated by means of the oven 3, whereby the paint forms a protecting layer for the sublimatic ink or inks, as aforesaid.

Objects then can be let to cool at room temperature or can be cooled at a predetermined temperature in the cooler 6.

After passing throughout the oven the objects 11*b* can travel again underneath the powder paint distributing 4 so as to be coated again by a suitable powder paint that can be the same as or differs from the already applied protecting paint layer, and then the objects can be subjected to a second heating step. As already stated, when providing a second coating step the images formed on the objects show brighter colors.

Throughout the method steps the sheets or tiles can be conveyed by a suitable conveyor, such a conveyor-belt, preferably a step conveyor-belt.

The invention as above described is susceptible to numerous modifications and variations within the scope as defined by the claims.

The invention claimed is:

1. A method of forming images or decorations on a support, comprising the following steps in sequence:

arranging at least one support;

applying at least one sublimatic ink including at least one solvent onto at least one surface of said support;

coating said at least one surface with at least one protecting compound; and heat-treating said support to cause said protecting compound to harden and said ink to sublime thereby forming an uninterrupted fixing and protecting layer for said at least one sublimatic ink, said at least one sublimatic ink becoming bound to the protecting compound while the protective compound undergoes a hardening process.

2. A method as claimed in claim 1, wherein said at least one sublimatic ink defines an image permanently fixable to said support by said fixing and protecting layer.

3. A method as claimed in claim 2, wherein said protecting layer is permeable to said at least one ink solvent while hardening.

4. A method as claimed in claim 1, wherein said protecting layer is a transparent layer.

5. A method as claimed in claim 1, wherein said protecting layer is a translucent layer.

6. A method as claimed in claim 1, wherein said at least one sublimatic ink is printed onto said at least one surface of said support.

7. A method as claimed in claim 6, wherein said at least one sublimatic ink is printed by means of an ink-jet printer.

8. A method as claimed in claim 6, wherein said at least one sublimatic ink is printed at a resolution ranging from 360 dpi to 1600 dpi.

9. A method as claimed in claim 1, wherein said at least one sublimatic ink is applied in an amount ranging from 1 to 25 $g/m^2$.

10. A method as claimed in claim 1, wherein said heat-treatment is carried out in an oven.

11. A method as claimed in claim 1, wherein said heat-treatment is carried out in an infrared oven.

12. A method as claimed in claim 1, wherein said heat-treatment is carried out at a temperature ranging from 100° C. to 300° C.

13. A method as claimed in claim 1, wherein said heat-treatment is carried out in a time interval ranging from 0.5 to 15 minutes.

14. A method as claimed in claim 1, wherein said at least one protecting compound comprises a powder paint.

15. A method as claimed in claim 14, wherein the thickness of said powder paint applied to said support ranges from 30 to 50 μm.

16. A method as claimed in claim 1, wherein said at least one protecting compound is a resin-based paint.

17. A method as claimed in claim 16, wherein said at least one resin-based paint is selected from the group comprising acrylic, aliphatic, aromatic, epossidic, epossipolyester, melaminic, polyester, polyurethanic-based paint.

18. A method as claimed in claim 1, wherein said support is a metallic support.

19. A method as claimed in claim 18, wherein said metallic support is a Fe, Al support.

20. A method as claimed in claim 1, wherein said support is a glass support.

21. A method as claimed in claim 1, wherein said support is a ceramics support.

22. A method as claimed in claim 1, wherein said support is a wooden support.

23. A method as claimed in claim 1, wherein said support comprises a polymeric material.

24. A method as claimed in claim 1, wherein said support comprises a mixture of polymeric and wooden materials.

25. A method as claimed in claim 24, wherein said support is a medium density fiberboard.

26. A method as claimed in claim 1, comprising at least a sequence of at least two coating and hardening steps of at least one protecting compound.

27. A method as claimed in claim 1, comprising applying at least one background layer of at least one paint to said at least one surface of said support before applying said at least one sublimatic ink to said support.

28. A method as claimed in claim 27, wherein said at least one background layer comprises at least one resin-based paint.

29. A method as claimed in claim 28, wherein said at least one resin-based paint is selected from the group comprising acrylic, aliphatic, aromatic, epossidic, epossipolyester, melaminic, polyester, polyurethanic-based paint.

30. A method as claimed in claim 28, wherein said at least one background layer is in contrast of color with said at least one sublimatic ink.

* * * * *